US008661979B2

(12) United States Patent
Veksler

(10) Patent No.: US 8,661,979 B2
(45) Date of Patent: Mar. 4, 2014

(54) GRENADE MECHANISM

(75) Inventor: Isar Veksler, Herzliya (IL)

(73) Assignee: Israel Military Industries Ltd., Ramat Hasharon (IL)

( * ) Notice: Subject to any disclaimer, the term of this patent is extended or adjusted under 35 U.S.C. 154(b) by 0 days.

(21) Appl. No.: 13/310,093

(22) Filed: Dec. 2, 2011

(65) Prior Publication Data

US 2012/0145029 A1 Jun. 14, 2012

Related U.S. Application Data

(63) Continuation of application No. PCT/IL2010/001044, filed on Dec. 12, 2010.

(51) Int. Cl.
*F42B 27/00* (2006.01)
*F42C 15/21* (2006.01)

(52) U.S. Cl.
USPC ..... 102/256; 102/487; 102/258; 102/261; 102/481

(58) Field of Classification Search
USPC ..... 102/481, 482, 487, 254, 256, 258, 259, 102/260, 261; 86/51, 56
See application file for complete search history.

(56) References Cited

U.S. PATENT DOCUMENTS

| | | | | |
|---|---|---|---|---|
| 3,823,670 A | | 7/1974 | Zacharin | |
| 3,865,027 A | | 2/1975 | Dubno et al. | |
| 4,730,559 A | * | 3/1988 | Brightman | 102/254 |
| 5,886,288 A | | 3/1999 | Brunn | |
| 6,082,267 A | * | 7/2000 | Cooper | 102/487 |
| 6,530,324 B1 | * | 3/2003 | Steele et al. | 102/254 |
| 7,712,419 B1 | * | 5/2010 | Cheng et al. | 102/487 |

FOREIGN PATENT DOCUMENTS

| | | | |
|---|---|---|---|
| EP | 1548394 A1 | | 6/2005 |
| FR | 2500620 A1 | | 8/1982 |
| FR | 2864220 A1 | * | 6/2005 |

OTHER PUBLICATIONS

International Search Report and Written Opinion of the International Searching Authority.

* cited by examiner

*Primary Examiner* — James Bergin
(74) *Attorney, Agent, or Firm* — Harness, Dickey & Pierce, P.L.C.

(57) ABSTRACT

An auxiliary safety mechanism for a grenade to prevent detonation from shockwaves, heat, fragments, etc., the grenade including a fuse housing containing a delay detonator and explosive train. In at least one embodiment, the fuse housing includes a reversible slider element interposed between the delay detonator and the rest of the explosive train to form a barrier therebetween when the grenade is in an unarmed condition, and when the slider element is withdrawn the barrier between the delay detonator and explosive train is removed leaving the grenade in an armed condition. In another embodiment, a further safety mechanism involves connecting the two sections of the housing with a weak connection that ruptures prior to the explosive contained therein reaching the critical explosive temperature/pressure.

13 Claims, 2 Drawing Sheets

GRENADE MECHANISM

This is a Continuation Application of and claims priority under U.S.C. §120 to PCT Patent Application No. PCT/IL2010/001044, filed on Dec. 12, 2010, the contents of which are hereby incorporated by reference in their entirety.

FIELD

The present application generally relates to hand grenades, in particular to safety features with respect of the grenades.

BACKGROUND

In typical present day hand grenades, the outer shell of the grenade is made of serrated steel sections welded together that holds a pyrotechnic fuse mechanism, which is surrounded by a high explosive material. The grenade has a filling hole for pouring in the high explosive material.

The firing mechanism is triggered by a spring-loaded striker inside the grenade. Normally, the striker is held in place by a striker lever, which is held in place by a safety pin, usually a cotter pin. The striker lever is held against the body of the grenade and when the pin is pulled out, the firing mechanism is triggered by the spring-loaded striker inside the grenade. With the pin removed, there is nothing holding the striker lever back, which means there is nothing restraining the striker from striking the blasting cap that initiates the delay column which burns slowly. In about four seconds, the delay material burns all the way through igniting the high explosive material that blows the grenade apart.

If for any reason one of the pyrotechnic components are activated, unintentionally, such as by extreme heat or by penetration of a bullet or fragment it inevitably causes the grenade to explode. Unintended explosion of a hand grenade can cause fatal injuries. If large numbers of grenades are stored in a single or enclosed storage area and if a grenade unintentionally explodes, the entire storage area could explode and cause great damage.

The aforementioned safety consideration imposes constraints on the storage and transportation of hand grenades and puts the personnel in vicinity of hand grenades at risk. It is also a waste of resources, which may be needed at any time.

The requirement for a safety measure to prevent inadvertent detonation is well known. It is also known to have a second safety measure to prevent inadvertent withdrawal of the safety pin. Thus, U.S. Pat. No. 3,865,027 relates to a hand grenade with a second safety measure. U.S. Pat. No. 3,823,670 relates to double headed cotter pin safety device. U.S. Pat. No. 5,886,288 discloses a safety pin that can be restored if circumstances warrant. FR 2 500 620 discloses a complex safety mechanism for a grenade. EP 1 548 394 A1 discloses an auxiliary safety mechanism for a grenade including a reversible slider element interposed between the delay detonator and the rest of the explosive train wherein the slider element is maintained under tension by the safety lever. Thus the safety mechanism is dependent on the safety lever, and any damage thereof will void this auxiliary safety mechanism.

SUMMARY

At least one embodiment of the present invention relates to an auxiliary safety mechanism that prevents accidental detonation of the grenade when the safety pin is in place. The auxiliary safety mechanism mechanically separates the ignition portion of the grenade from the explosive charge with a slider element while the grenade is in a safe mode, independent of the safety lever. The slider element is withdrawn only by removing the grenade's safety pin. This allows normal use of the grenade without any further activity required by the user.

At least one embodiment of the present invention relates to a further safety feature of the grenade, whereby the two halves of the outer shell of the grenade are not welded together but attached to one another in a way that they will come apart when a bullet or shrapnel penetrate the grenade before the explosive material contained therein has a chance to explode. This can be achieved in a number of ways, for example, by crimping together the circumferences of the shell sections, or by threading them together with only one thread providing a relatively weak connection, sufficient to withstand normal handling and even low shock forces such as when dropped by accident. When, on the other hand, greater force is applied to the grenade, the shell sections will be forced to separate reducing the pressure on the explosive material, preventing its explosion.

The term "grenade" will be used in its broadest sense and include any munitions that are similarly ignited/exploded/operated; for example demolition charges, hand emplaced ordnance, etc.

In at least one embodiment of the present invention, an auxiliary safety mechanism for a grenade is provided.

In at least one embodiment of the present invention, a grenade with at least one auxiliary safety mechanism is provided.

In at least one embodiment of the present invention, a grenade with two novel safety mechanisms is provided.

In at least one embodiment of the present invention, a method of producing a grenade with an auxiliary mechanism is provided.

It is a particular feature of the auxiliary safety mechanism of an embodiment of the present invention that it requires little or no change to the look and feel of the grenade.

It is another particular feature of the auxiliary safety mechanism of an embodiment of the present invention that it does not change the method of operating the grenade.

In accordance with one embodiment of this invention there is provided an auxiliary safety mechanism for a grenade that will prevent unintentional detonation, such as from shockwaves, fragments, heat, etc., said grenade comprising a fuse housing containing a delay detonator and explosive train, and striker mechanism and further comprises a reversible slider element interposed between the delay detonator and explosive train to form a barrier between them when the grenade is in a safe condition, and when the slider element is withdrawn the barrier between the delay detonator and explosive train is removed characterized in that the slider element is restrained by the striker mechanism.

In particular, an embodiment of the invention relates to an auxiliary safety mechanism for a grenade wherein the fuse housing comprises,

- a bore containing in series a delay detonator and explosive train,
- a safety lever held in position by a removable safety pin,
- a spring activated striker held under tension by the removable safety pin, and
- an auxiliary safety mechanism, comprising:
- a slider element having a relay charge at one end thereof and a flanged edge at the other end,
- tension means for extending said slider element to form a barrier between the delay detonator and explosive train, and means for releasing the tension means of the slider element and aligning the relay charge with the delay detonator and explosive train, characterized in that the slider element is held under tension by the striker mechanism, whereby removing the safety pin will free the striker mechanism to relieve the tension on the slider element, thereby arming the grenade.

Thus if the safety lever is damaged neither the striker nor the slider will be activated until the safety pin is removed.

In another embodiment of this invention, the housing is comprised of two shell sections having circumferences, the sections being connected to each other around their circumferences by means that are severed when exposed to the force of a bullet or shrapnel penetrating the grenade. The shell sections can be connected, for example, by means of a single thread screw mechanism, or by crimping the circumferences together.

An embodiment of the invention also relates to a grenade having such an auxiliary safety mechanism.

BRIEF DESCRIPTION OF THE DRAWINGS

The invention may be more clearly understood upon reading of the following detailed description of non-limiting example embodiments thereof, with reference to the following drawings, in which.

DETAILED DESCRIPTION OF THE INVENTION

Figure 1:
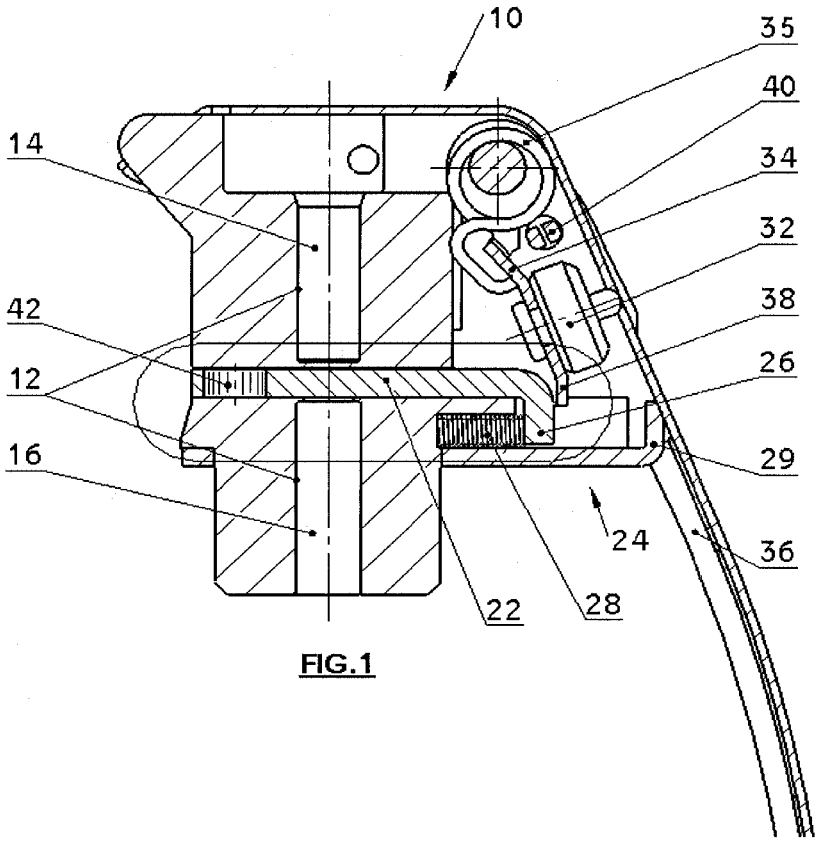
FIG. 1 is a cross-sectional view of a fuse housing of a grenade comprising an auxiliary safety mechanism in accordance with an embodiment of the present invention, in its "safe" condition.
Figure 2:
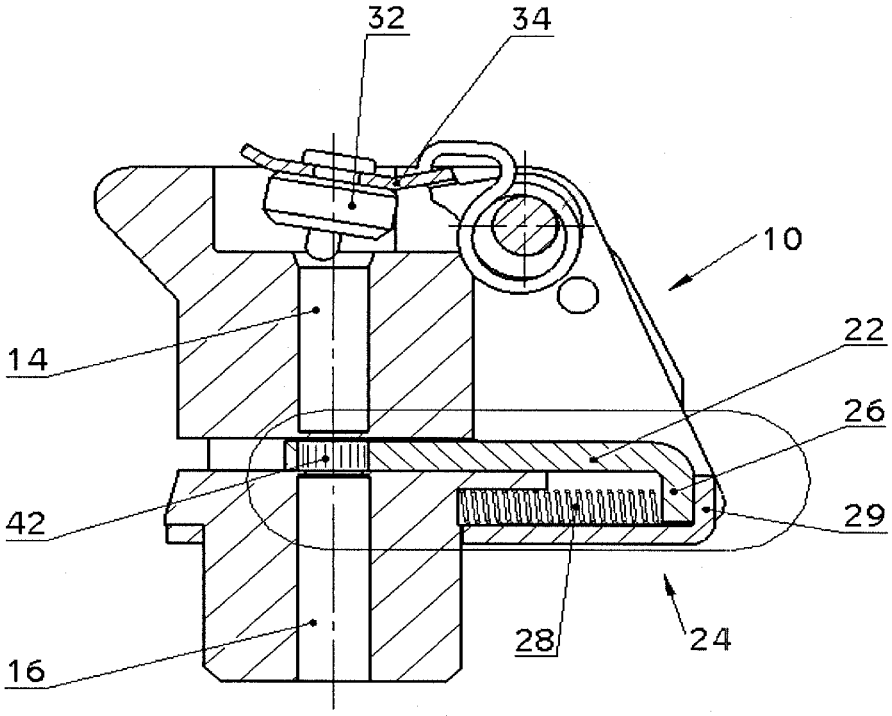
FIG. 2 is a cross-sectional view of a fuse housing of a grenade comprising the auxiliary safety mechanism of an embodiment of the present invention, in its "activated" or "armed" condition.

Referring first to FIGS. 1 and 2, there is shown a fuse housing 10 of a grenade with an auxiliary safety mechanism 24 in accordance with an embodiment of the present invention in a safe and armed condition, respectively. The grenade body housing a main charge is not shown.

In FIG. 1 the fuse housing 10 is shown in a safe condition and in FIG. 2 in an armed condition. The fuse housing 10 has a bore 12 containing a delay detonator 14 near its upper end and an explosive column 16 at its lower end. A striker 32 is attached to a striker lever 34 having an edge 38 is held under tension by a spring 35 and is held in its place by the safety pin 40. An auxiliary safety mechanism 24 includes the slider element 22 having at one end a relay charge 42 and at the other end a flanged edge 26. The edge 38 of the striker lever 34 presses against the end 26 of the slider element 22 compressing the slider spring 28 and pushes the slider element 22 forward traversing the explosive train separating the delay detonator 14 from the explosive column 16. As long as the safety pin 40 is in place (FIG. 1), the striker 32 is in a safe orientation and the slider element 22 traverses the explosive train. If the pin 40 is removed, the safety lever 36 still prevents the striker 32 from striking the delay detonator 14. However, if the safety lever 36 should be damaged, the striker 32 and slider element 22 will still be in place as a back-up safety system as long as the safety pin 40 is not removed.

FIG. 2 illustrates the fuse housing 10 with the safety pin 40 removed and the safety lever (not shown) pivoted away from the body of the grenade. The striker spring 35 now urges the striker lever 34 and the striker 32 to pivot away from the body so that the striker 32 strikes the delay detonator 14 and ignites it. At the same time the tension is relieved from the slider spring 28 which expands, retracting the slider element 22 till the stopper 29 and bringing the relay charge 42 in alignment with the bore 12, enabling the detonation of the delay detonator 14 to explode the explosive column 16 when the delay detonator 14 detonates.

The essence of this embodiment is thus, in the auxiliary safety mechanism which comprising a mechanical slider element introduced into the explosive train of the grenade that separates the delay detonator from the rest of the explosive train with little or no effect on the external look and feel of the grenade, is dependent only on the safety pin, has no effect on its operation as far as the grenadier is concerned, and comprises simple and inexpensive components.

Figure 3:
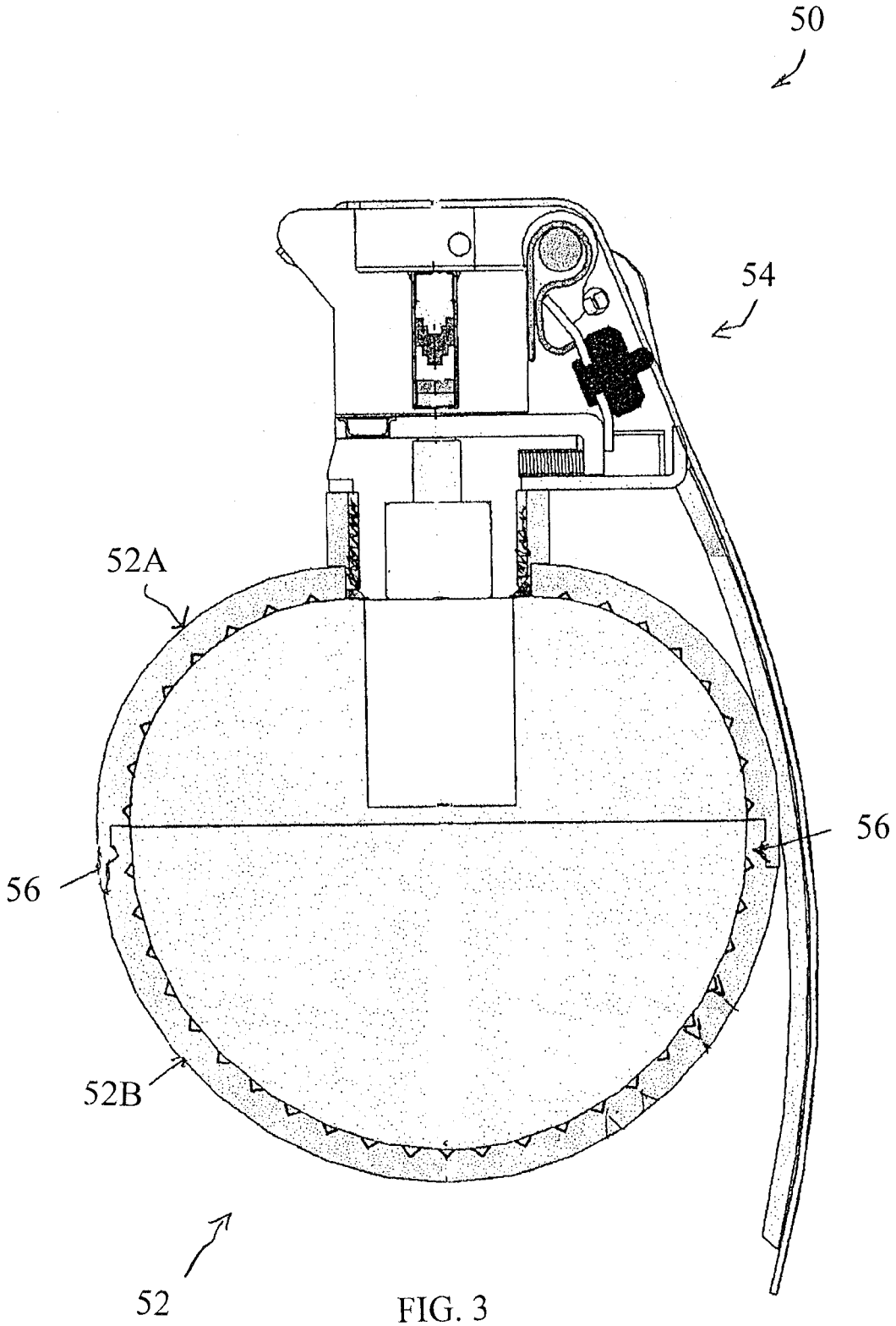
FIG. 3 shows in cross-section a grenade in accordance with another embodiment of the invention.

Referring now to FIG. 3, here is shown a grenade 50 having a housing 52 and activating mechanism 54. The housing 52 is comprised of two shell sections 52A and 52B. These sections are crimped 56 to each other. This connection is sufficiently strong to hold the sections together and withstand ordinary forces, such as when accidentally dropping the grenade. However, if a bullet would penetrate the shell, the heat generated therein would create sufficient pressure to rupture the connection between the two shell sections before the explosive therein reaches its detonation temperature. The shell sections can be connected by other things, such as by a single circumferential thread, or any other device that will hold the shell sections together under normal pressure before bursting, and will disconnect under high pressure, but below that required to activate the explosive contained therein.

It should be understood that the above description is merely exemplary and that there are various embodiments of the present invention that may be devised, mutatis mutandis, and that the features described in the above-described embodiments may be used separately or in any suitable combination; or the invention can be devised in accordance with embodiments not necessarily described above.

What is claimed is:

1. An auxiliary safety mechanism for a grenade to prevent detonation, the grenade including a fuse housing containing a delay detonator, explosive train, safety lever, spring activated striker mechanism, and a safety pin, the auxiliary safety mechanism comprising:

a reversible slider element, interposed between the delay detonator and the explosive train, the reversible slider element being configured to form a barrier between the delay detonator and the explosive train when the slider element is under tension, the slider element being maintained under tension by the striker mechanism, and the safety pin being configured to restrain pivoting of both the safety lever and striker mechanism.

2. An auxiliary safety mechanism as claimed in claim 1, further comprising:

at least one stop device to engage the terminal end of the slider element to limit extension of the slider element.

3. An auxiliary safety mechanism as claimed in claim 1, wherein the safety pin is configured to restrain the pivoting of both the safety lever and the striker mechanism.

4. An auxiliary safety mechanism as claimed in claim 1, wherein the slider element is held under tension by an end of the striker mechanism.

5. A grenade comprising a fuse housing and auxiliary safety mechanism as claimed in claim 1.

6. A grenade as claimed in claim 5, wherein the fuse housing comprises two interfacing shell sections, wherein an interface formed by the two interfacing shell sections is configured to be sufficiently strong to maintain integrity of the housing and to withstand bursting under ordinary handling and limited pressure, and wherein the interface is configured to burst into separate the two interfacing shell sections when the shell is penetrated or heated to a temperature just below a temperature required to activate any explosive contained in the housing.

7. An auxiliary safety mechanism for a grenade including a fuse housing, a bore containing in series a delay detonator and explosive train, a safety lever, a spring activated striker mechanism, and a safety pin, the auxiliary safety mechanism comprising:

a slider element, including a relay charge at one end and a terminal end in contact with at least one tension device, the at least one tension device being configured to extend and retract the slider element to provide a barrier between the delay detonator and explosive train when the at least one tension device is compressed, and being configured to align the relay charge with the delay detonator and explosive train when the at least one tension device is released, the safety pin maintaining the spring and striker mechanism under tension and the slider element being held under tension by at least part of the striker mechanism.

8. An auxiliary safety mechanism according to claim 7, wherein the at least one tension device includes a spring.

9. An auxiliary safety mechanism as claimed in claim 8, where the spring is a coil spring.

10. An auxiliary safety mechanism as claimed in claim 7, wherein the slider element is disposed parallel and above the at least one tension device and a terminal end of the slider element engages one end of the at least one tension device.

11. A grenade comprising a fuse housing and auxiliary safety mechanism as claimed in claim 7.

12. A method of constructing a grenade to withstand shock waves without detonating, comprising:

introducing an auxiliary safety mechanism into the grenade to prevent detonation, the grenade including a fuse housing containing a delay detonator, explosive train, safety lever, spring activated striker mechanism, and a safety pin, the auxiliary safety mechanism including a reversible slider element, interposed between the delay detonator and the explosive train, the reversible slider element being configured to form a barrier between the delay detonator and the explosive train when the slider element is under tension, the slider element being maintained under tension by the striker mechanism, and the safety pin being configured to restrain pivoting of both the safety lever and striker mechanism.

13. A method of storing grenades safely without fear of detonation during storage, comprising:

storing said grenades, each equipped with auxiliary safety mechanisms, each grenade including a fuse housing containing a delay detonator, explosive train, safety lever, spring activated striker mechanism, and a safety pin, and each auxiliary safety mechanism including a reversible slider element, interposed between the delay detonator and the explosive train, the reversible slider element being configured to form a barrier between the delay detonator and the explosive train when the slider element is under tension, the slider element being maintained under tension by the striker mechanism, and the safety pin being configured to restrain pivoting of both the safety lever and striker mechanism.

* * * * *